United States Patent [19]

Filson

[11] 3,945,709

[45] Mar. 23, 1976

[54] SNAP SPADE ELECTRICAL CONNECTOR AND METHOD OF MANUFACTURE

[75] Inventor: John Richard Filson, Medford, N.J.

[73] Assignee: Minnesota Mining and Manufacturing Company, St. Paul, Minn.

[22] Filed: Dec. 5, 1974

[21] Appl. No.: 529,899

Related U.S. Application Data

[63] Continuation-in-part of Ser. No. 479,313, June 14, 1974.

[52] U.S. Cl. ..... 339/257; 29/630 A; 339/277 R; 339/278 R

[51] Int. Cl.[2] ..... H01R 11/22

[58] Field of Search ..... 339/252, 253, 256–258, 339/277, 278; 113/119; 29/629, 630 A; 248/73, 74 R, 113, 200; 211/65; 72/377, 379; 24/224, 230, 257

[56] References Cited

UNITED STATES PATENTS

| | | | |
|---|---|---|---|
| 911,032 | 2/1909 | Dow | 339/257 |
| 955,747 | 4/1910 | Barcy | 339/257 |
| 1,767,808 | 6/1930 | Nietman | 29/630 A |
| 3,234,498 | 2/1966 | Logan | 339/277 R |

FOREIGN PATENTS OR APPLICATIONS

| | | | |
|---|---|---|---|
| 426,937 | 4/1935 | United Kingdom | 339/277 R |

*Primary Examiner*—Joseph H. McGlynn

[57] ABSTRACT

A snap spade electrical connector including a generally flat U-shaped part having extending legs provided with inner projections defining a constriction, and work-hardened regions associated with the projections to reinforce the latter, including the method of manufacturing wherein the projections and workhardened regions are formed by swaging.

11 Claims, 5 Drawing Figures

FIG. 1
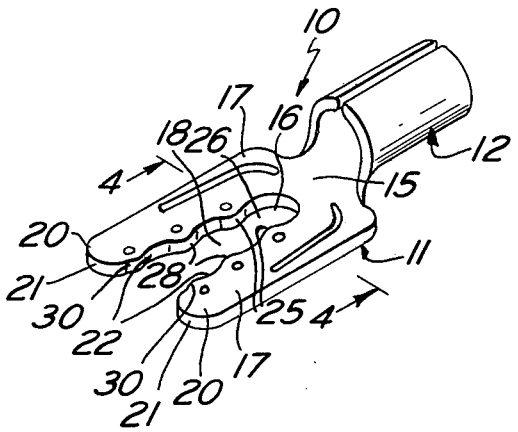
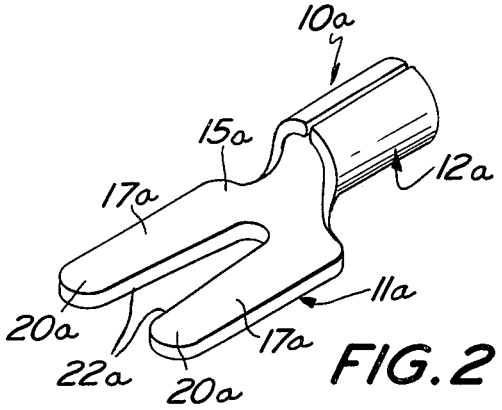
FIG. 2
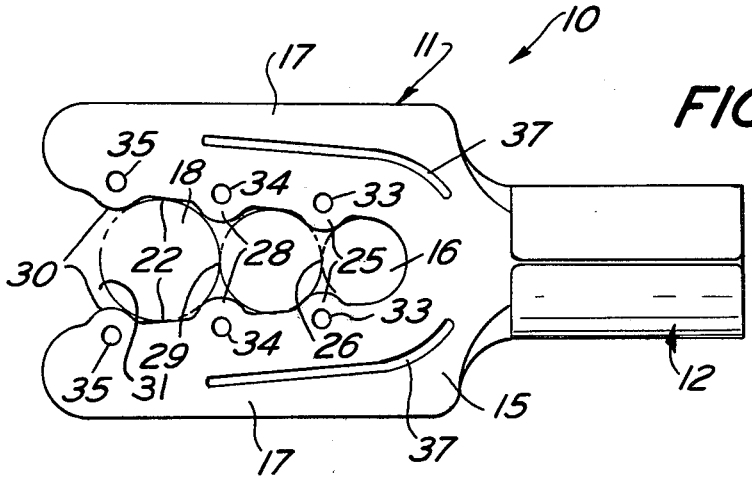
FIG. 3
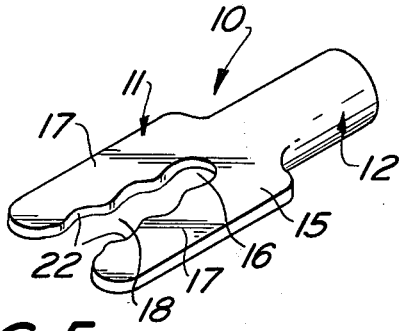
FIG. 5
FIG. 4
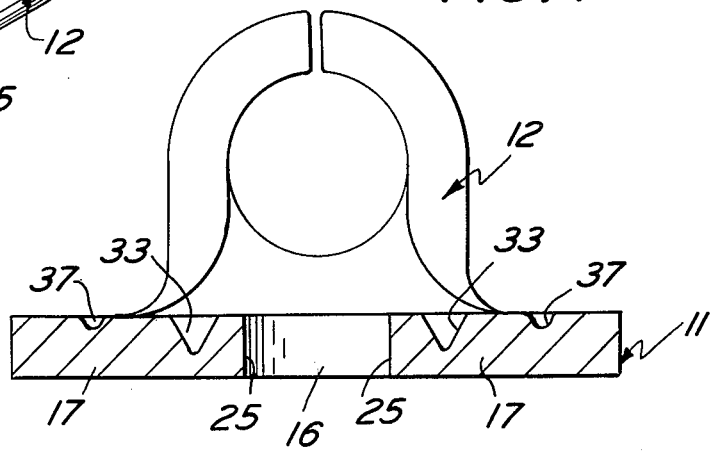

SNAP SPADE ELECTRICAL CONNECTOR AND METHOD OF MANUFACTURE

CROSS-REFERENCES TO RELATED APPLICATIONS

This application is a continuation-in-part of U.S. patent application Ser. No. 479,313, filed June 14, 1974 entitled SNAP SPADE ELECTRICAL CONNECTOR, assigned to the same Assignee.

BACKGROUND OF THE INVENTION

In addition to the requirements of repeated resilient deflectability without loss of resilience, as discussed in said parent patent application, the prior art spade connectors were generally incapable of accommodating different sizes of studs without breakage or malfunction, and if adapted for use with studs of different sizes the costs of manufacture were extremely high and reliability was inadequate. Further, repeated snap engagement of prior art spade connectors with engaging studs effected relatively rapid deterioration of the snap action.

SUMMARY OF THE INVENTION

It is, therefore, an important object of the present invention to provide a snap spade electrical connector and method of manufacturing the same which overcome the above-mentioned difficulties, wherein a single connector may be admirably well suited for use with a multiplicity of studs of different sizes in resilient snap engagement therewith, wherein repeated snap engagement and disengagement of a single connector does not appreciably adversely affect the resilient interaction, and wherein improved methods of manufacture are capable of producing spade connectors having the foregoing advantages, both for use with single and multiple stud sizes, which methods effect substantial savings in manufacturing costs.

The instant invention further advances the objects of said parent patent application wherein use is permitted of more economical materials, such as one-quarter hard copper, or the like, to effect substantial savings in costs and afford ample ductility for satisfactory crimping, all while achieving entirely satisfactory resilience and wearing characteristics for repeated snap engagement procedures.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

BRIEF DESCRIPTION OF THE DRAWINGS

FIG. 1 is a top perspective view illustrating a snap spade electrical connector constructed in accordance with the teachings of the instant invention.

FIG. 2 is a top perspective view showing an intermediate stage in manufacture of the snap spade connector of FIG. 1.

FIG. 3 is a top plan view of the connector of FIG. 1, enlarged for clarity.

FIG. 4 is a sectional view taken generally along the line 4—4 of FIG. 1, also enlarged.

FIG. 5 is a bottom perspective view of the connector of FIG. 1.

DESCRIPTION OF THE PREFERRED EMBODIMENTS

Referring now more particularly to the drawings, and specifically to FIG. 1 thereof, a spade connector is there generally designated 10, and may be integrally fabricated of a single sheet of suitable conductive material, such as relatively soft copper or brass, as by stamping and forming. More particularly, the spade connector 10 may include a generally flat or planar part 11 for receiving engagement with a desired stud, screw or lug. The flat, lug engaging part 11 may be of generally U-shaped overall configuration for reception of a lug or stud, and may be provided with an outwardly extending integral tubular formation or barrel part 12, for reception of an uninsulated or stripped conductor or wire (not shown). By suitable metal working techniques, the spade connector 10 may be formed from an integral sheet of suitably deformable conductive material, say of relatively inexpensive, soft copper or brass.

The planar or flat, U-shaped lug engaging part 11 may include a bight portion 15 having formed therein a generally arcuate cutout or lug receiving open region 16. Extending from opposite ends of the generally flat bight portion 15, generally coplanar therewith, are a pair of elongate side portions or legs 17, also substantially flat and coplanar with each other and the bight portion 15. The legs 17 may be substantially identical to each other, but of opposite hand, extending generally parallel and longitudinally from opposite ends of the bight portion 15 on opposite sides of said open region 16 and defining therebetween a longitudinally inwardly extending passageway 18 which opens into the open region 16.

The longitudinal extensions or legs 17 are of a generally tapering or reducing dimension from the bight region 15 in the direction toward the free leg ends 20, which may terminate in smooth, arcuate edges 21. While the legs 17 may each diminish or taper toward its free end, their inner edges or facing surfaces 22 are generally divergent in the direction toward the free leg ends, so that the passageway 18 may be considered as generally flaring toward the free leg ends.

However, the inner leg edges or facing leg surfaces 22 are each provided with at least a pair of opposed inner projections, as at 25 extending into the passageway 18. That is, the inner leg edges 22 are configured to each project, respectively, as at 25, into the passageway 18, toward and terminating short of each other, to thereby define therebetween a passageway construction 26.

While a single pair of opposed inner projections, as at 25, will suffice to snap engage past and releasably retain lugs of a single or limited size range, there may be provided a plurality of additional pairs of opposed inner projections extending toward and terminating short of each other at different interprojection distances, so as to accommodate different sizes or size ranges of lugs.

More particularly, an additional pair of opposed inner projections on the inner surfaces or edges of legs 17 is shown projecting toward each other into passageway 18 spaced from the inner projections 25 in the direction toward the free ends 20 of legs 17, as at 28. The pair of projections 28 terminates short of each other to define therebetween an additional constriction 29 in passageway 18.

Still another pair of opposed inner projections 30 may be formed on respective legs 17 extending into passageway 18 toward and terminating short of each other to define therebetween a constriction 31. As illustrated, the constriction 29 adjacent to the innermost constriction 28 is appreciably larger than the latter, while the outermost constriction 31 adjacent to the intermediate constriction 29 is appreciably larger than its adjacent constriction.

It will therefore be appreciated that each inward constriction 31, 29 and 28 is adapted to pass by snap engagement and releasably retain a progressively smaller size of screw or stud, so that a single connector may be self-retaining on a multiplicity of stud sizes.

It will be observed, as in the perspective views of FIGS. 1 and 5, and the sectional view of FIG. 4 that the protruding edge portions 25, 28 and 30 are not thinned, but of generally the same thickness as the remaining portions of inner leg edges 22. This enhances the wear characteristics of the projections 25, 28 and 30 upon repeated snap engagement thereof. Further, the projecting regions 25, 28 and 30 are reinforced or rigidified by work hardening, as by work-hardened regions 33, 34 and 35. That is, a pair of generally circular work-hardened regions 33 are each located in adjacent conforming relation with respective inner projections 25 to reinforce the latter; and similarly a pair of generally circular work-hardened regions 34 are located in adjacent conforming relation with respective projections 28; and further, the pair of generally circular work-hardened regions 35 are similarly located in adjacent conforming relation with respective projections 30. By this means, the projections 25, 28 and 30 are all effectively work-hardened for increasing resilience for repeated snap engagement, as well as frictional wear.

Specifically, the work-hardened regions 33, 34 and 35 may each be defined by a depression or dimple on the upper leg surface, formed by swaging, staking or impaling.

Also formed on the upper surface of each leg 17 may be an additional work hardened region 37, say in the form of an elongate groove, also formed by a suitable punching or coining tool. Thus, the work-hardened regions 33, 34 and 35, as well as the work hardened regions 37 are all defined by compressed material resulting in depressed configurations in one side of the legs 17, the other face or underside thereof being generally flat, as seen in FIG. 5.

The compressed locations or work-hardened regions 37 may be generally straight extending along respective legs 17 and curving arcuately into adjacent portions of the bight portion 15. Thus, the work-hardening or rigidifying effect of compressed regions 37 enhances the resilient flexibility of the legs 17.

In accordance with the method of the instant invention, by suitable punching and stamping there may be formed a part 10*a* as shown in FIG. 2. The part 10*a* represents an intermediate stage of the instant method and includes a generally flat planar part 11*a* of a generally U-shaped overall configuration, and an integrally outwardly extending barrel part 12*a*. The planar or flat part 11*a* may include a bight portion 15*a* and elongate side portions or legs 17*a* extending from opposite ends of the bight portion. The legs 17*a* may be substantially identical to each other, but of opposite hand, extending longitudinally of each other and tapering toward their ends 20*a*. The inner edges or facing surfaces 22*a* of the intermediate part 10*a* may be substantially straight and diverge or flare in the direction toward the free leg ends 20*a*. By this configuration die costs are considerably reduced, and die life is enhanced, while machine operation is simplified.

It is then only necessary to impale, stake or swage opposite portions of legs 17*a* to distend the latter and define the inner projections 25, 28 and 30. In particular, punching, coining or staking as by the impaling, depressing or compressing of the legs 17*a* at locations spaced from the inner leg surfaces 22*a*, but adjacent to the latter, serves to bulge or distend the adjacent portions of the inner leg edges or surfaces in conformance with the coining or punching tool, while assuring full thickness and maximum wear characteristics to the distended leg portion. If desired, the elongate work-hardened or depressed regions 37 may be formed simultaneously with the work-hardened regions 33, 34 and 35. As seen in FIG. 4, the under surface of the part 11 is fully supported to maintain its planarity under the punching or coining operations.

From the foregoing, it is seen that the present invention provides a unique construction of snap spade connector, and method of manufacturing the same, which effects substantial economies in production, and enhance useful life, and which otherwise fully accomplish their intended objects.

Although the present invention has been described in some detail by way of illustration and example for purposes of clarity of understanding, it is understood that certain changes and modifications may be made within the spirit of the invention.

What is claimed is:

1. A snap spade electrical connector comprising a generally flat U-shaped lug engaging part including a bight portion having a lug receiving open region, and a pair of legs extending longitudinally of each other from opposite ends of said bight portion on opposite sides of said open region and defining therebetween a longitudinally inwardly extending passageway opening into said open region, a pair of opposed inner projections on respective legs spaced from the free ends thereof and extending into said passageway toward and terminating short of each other to define a passageway constriction, said legs and inner projections being generally flat and coplanar with said bight portion, and a work-hardened region located in adjacent conforming relation with each of said projections for reinforcing the latter against repeated snap engagement of a lug through said constriction, said work-hardened regions each comprising a compressed location defining a surface recess on one side and being generally nonprotuberant on the other side.

2. A snap spade electrical connector according to claim 1, said depressions being generally round.

3. A snap spade electrical connector according to claim 1, in combination with additional work hardened regions each extending along a respective leg and into said bight portion.

4. A snap spade electrical connector according to claim 1, in combination with a conductor receiving barrel part extending integrally from said bight portion away from said legs, said barrel part and lug engaging part being of relatively soft deformable material for good connection to a conductor in said barrel part with said legs and projections being rigidified by said work-hardened regions for said snap lug engagement.

5. A snap spade electrical connector according to claim 1, said legs having their inner surfaces diverging from said open region, additional pairs of opposed inner projections on respective legs extending into said passageway toward and terminating short of each other to define additional passageway constrictions, and additional work-hardened regions located in adjacent conforming relation with each of said additional projections for reinforcing the latter against fatigue by repeated snap engagement of a lug through said constrictions, each pair of said projections terminating at a greater distance short of each other in the direction away from said open region for snap engagement of different size lugs through respective constrictions.

6. In the method of manufacturing a snap spade electrical connector, the steps which comprise: providing a generally flat U-shaped part including a bight portion and divergent legs extending from opposite ends of the bight portion, and swaging said legs to indent the same on at least one side without protuberance on the other side to displace opposed leg portions inwardly and define inner projections providing a constriction for snap engagement therethrough of a lug.

7. The method of manufacturing a snap spade electrical connector according to claim 6, further characterized in swaging said legs to indent the same by impressing the legs at locations spaced from the inner leg surfaces to avoid thinning at the inner leg surfaces while distending the inner leg surfaces inwardly.

8. The method of manufacturing a snap spade electrical connector according to claim 6, further characterized in additionally swaging said legs to indent the same at additional different locations to distend additional opposed leg portions inwardly and define additional inner projections providing additional constrictions of different sizes for snap engagement therethrough of different size lugs.

9. The method of manufacturing a snap spade connector according to claim 8, further characterized in swaging said legs to indent the same by impressing the legs at locations spaced from the inner leg surfaces to avoid thinning at the inner leg surfaces while distending the inner surfaces inwardly.

10. The method of manufacturing a snap spade electrical connector according to claim 8, further characterized in providing said part before swaging by stamping.

11. The method of manufacturing a snap spade electrical connector according to claim 10, further characterized in stamping said part with generally straight inner leg surfaces, said first mentioned and additional swaging distending said legs to define undulant inner leg surfaces.

* * * * *